US005941191A

United States Patent [19]

Dysarz

[11] Patent Number: 5,941,191

[45] Date of Patent: Aug. 24, 1999

[54] MULTIDIRECTIONAL BOAT AND DOCK CLEAT

[76] Inventor: Edward D. Dysarz, 11423 Triola La., Houston, Tex. 77072

[21] Appl. No.: 09/001,838

[22] Filed: Dec. 31, 1997

[51] Int. Cl.[6] ..... B63B 21/04

[52] U.S. Cl. ..... 114/218; 114/230

[58] Field of Search ..... 114/218, 230, 114/293

[56] References Cited

U.S. PATENT DOCUMENTS

| | | | |
|---|---|---|---|
| 988,743 | 4/1911 | Stillwaggon | 248/225.1 |
| 2,859,710 | 1/1958 | Elsner | 248/222.3 |
| 2,912,953 | 11/1959 | Olsen | 114/230 |
| 2,940,558 | 6/1960 | Schulueter | 248/222.3 |
| 2,954,909 | 10/1960 | Miller et al. | 248/514 |
| 3,122,120 | 2/1964 | Jorgenson | 114/230 |
| 3,313,509 | 4/1967 | Lockert | 248/222.3 |
| 3,670,686 | 6/1972 | Reynolds | 114/230 |
| 3,780,690 | 12/1973 | Mcgahee | 114/218 |
| 3,838,659 | 10/1974 | Coleman | 114/218 |
| 3,902,269 | 9/1975 | Dunlap | 248/534 |
| 4,297,963 | 11/1981 | Beacom | 114/230 |
| 4,410,157 | 10/1983 | Monti et al. | 248/297.2 |
| 4,527,349 | 7/1985 | Emory, Jr. | 248/534 |
| 4,582,287 | 4/1986 | Dekorg | 248/539 |
| 5,120,016 | 6/1992 | Dysarz | 248/539 |

*Primary Examiner*—Stephen Avila

[57] ABSTRACT

A device that is fastened to a boat, dock or pier wherein the device is in the configuration of a mushroom top at the upper end, a base plate at the lower end and a stanchion fixing the base plate to the mushroom top and wherein a ring with an extended finger is loosely disposed about the stanchion between the mushroom top and the base plate thereby allowing the ring to rotate freely and wherein the device is either fixed to a dock or a boat wherein a rope that has a knot on the first end of said rope is inserted into a slot formed in said extended finger wherein said knot cannot be pulled from said slot formed in said extended finger thereby fixing the first end of the rope to a first device that is fixed to dock and wherein the second end of the rope is tied to a ring that is disposed about a stanchion of a second device that is fixed to the boat thereby warping said boat to said dock or pier.

6 Claims, 5 Drawing Sheets

MULTIDIRECTIONAL BOAT AND DOCK CLEAT

BACKGROUND OF THE INVENTION

There are various types of boat cleats available but none with a freely moving ring that has an extended tie on finger for easy and safe tie on.

SUMMARY

It is the object of the present invention to provide a means for warping a vessel without having to tie a knot on a cleat.

It is another object of the present invention to provide a means for warping a vessel wherein the vessel may rotate about the cleat without causing the rope to wind around the cleat.

It is yet another object of the present invention to provide a low profile cleat for a boat.

It is still yet another object of the present invention to provide a cleat that is easily installed on a dock or removed from a dock.

The features of the present invention can best be understood together with further objects and advantages by reference to the following descriptions taken in conjunction with accompanying drawings wherein like numerals indicate like parts.

DETAILED DESCRIPTION OF THE PREFERRED EMBODIMENT

Figure 1:
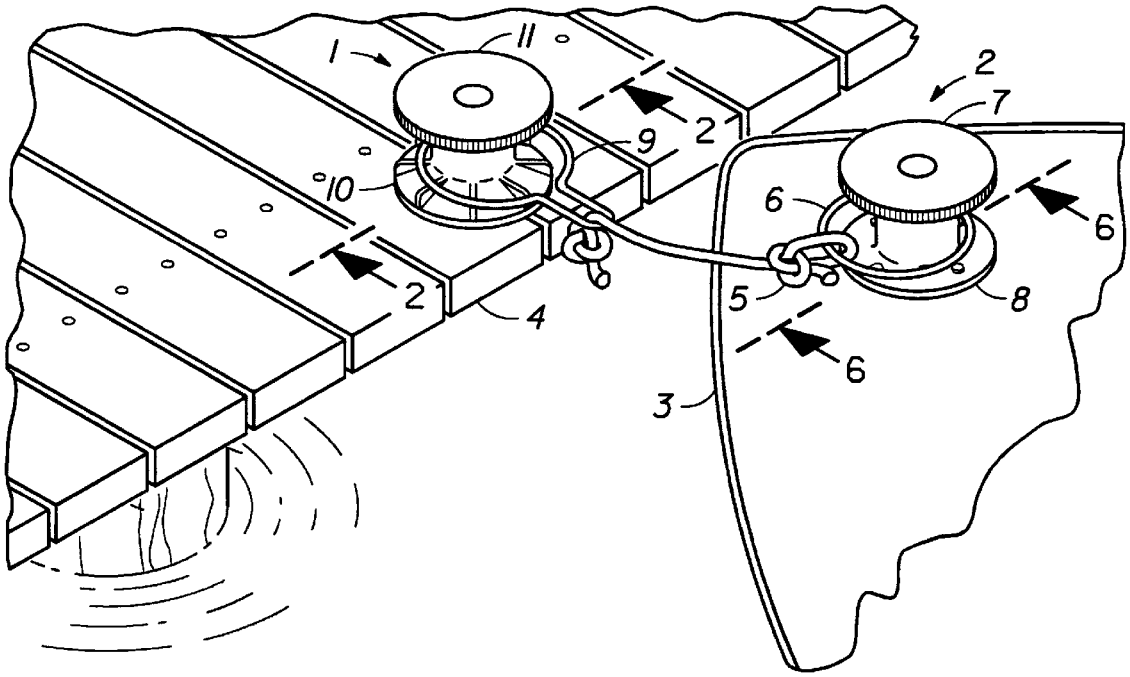
FIG. 1 is an isometric view of the device of the first preferred embodiment fixed to a dock and a second device of the second preferred embodiment fixed to a boat with a rope tied from the first device to the second device.

Referring to FIG. 1 there is shown an isometric view of the first device 1 of the first preferred embodiment fixed to a dock 4 and the second device 2 of the second preferred embodiment fixed to a boat 3.

The first device 1 is suitably fixed to the dock 4 with an H bar while the second device 2 is suitably fixed to the boat 3 with bolts and nuts not seen clearly in this view. The first device 1 that is suitably fixed to a dock 4 is shown with the first end of the rope 5 tied to the finger ring 9 which is loosely disposed around the tee rim and between the threaded mushroom head 11 and the threaded base plate 10. The ring 6 shown is on the second device 2. The ring 6 is also loosely disposed about the stanchion held between the mushroom head 7 and the bolted on base plate 8.

Figure 2:
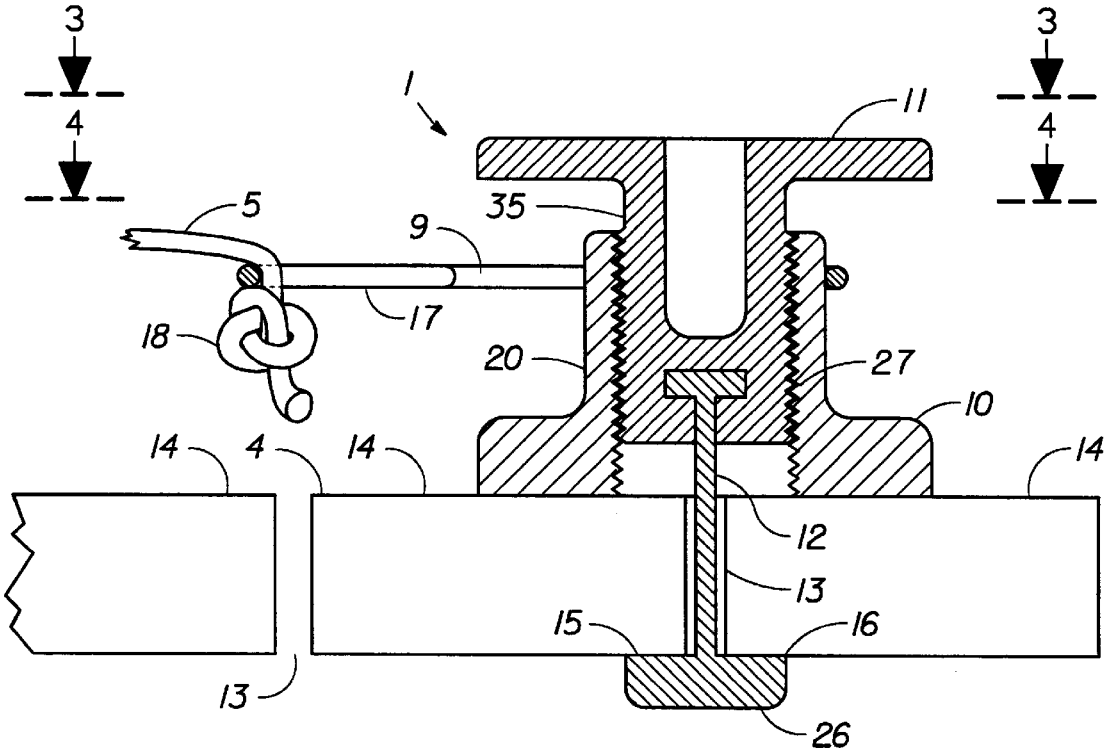
FIG. 2 is a section elevation view of the first device fixed to a dock.

Referring to FIG. 2 there is shown a section elevation view of the first method and device 1 of the first preferred embodiment suitably fixed to a dock 4.

The threaded mushroom head 11 is shown with the H bar 12 embedded in the second end of the threaded stem 35 of the threaded mushroom head 11. The embedded H bar 12 is shown suitably embedded in the second end of the threaded mushroom head 11 and therefore rotates when the threaded mushroom head 11 rotates. The H bar 12 will not rotate when the threaded mushroom head is held or otherwise prevented from rotating.

The method of fastening or fixing the first device 1 to the deck, dock or pier is to insert the first end of the H bar 12 into the slot 13 between the planks 14 that make up the dock 4, deck or pier. The T bar is rotated by the threaded mushroom head 11 more than four degrees or less than one hundred and seventy degrees until the first wing 15 and the second wing 16 are below the underside of the planks 14 wherein the threaded base plate 11 is rotated further causing the threads 27 to rotate and push up on the threaded mushroom head 11 thereby pulling up on the H bar until the first wing 15 and the second wing 16 of the T bar 26 are pulled tight against the underside of the planks 14 thereby fixing the first device 1 to the dock 4.

The second end of the rope 5 is shown secured in the finger slot 17 of the finger ring 9. The finger ring 9 has a greater inside diameter than said threaded tee rim 20 and a lessor outside diameter than the first end of the threaded mushroom head 11 and the threaded base plate 10. The finger slot 17 is just wide enough to allow the rope 5 to slide into the finger slot 17 but will not allow the knot 18 to be pulled out of the finger slot 17.

Figure 3:
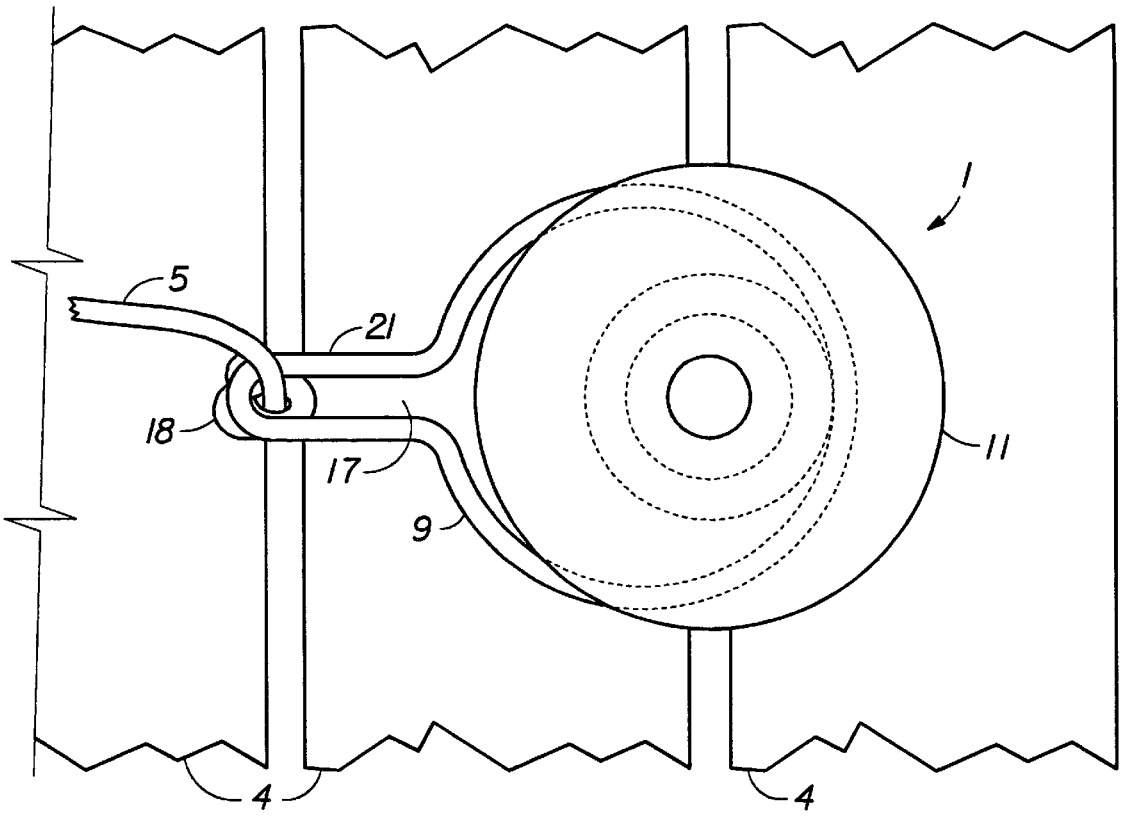
FIG. 3 is a plan view of the first device fixed to a dock.

Referring to FIG. 3 there is shown a plan view of the first device 1 fixed to a dock 4 and the method of its use.

The rope 5 is shown disposed in the finger slot 17 formed in the ring finger 21 that is loosely held between the threaded mushroom head 11 and the threaded base plate. The rope 5 with a knot 18 is placed in the first end of the ring finger 21 where the ring finger 21 intersects the finger ring 9 and the rope 5 is slid to the second end of the ring finger 21 wherein the rope 5 cannot be pulled out.

Figure 4:
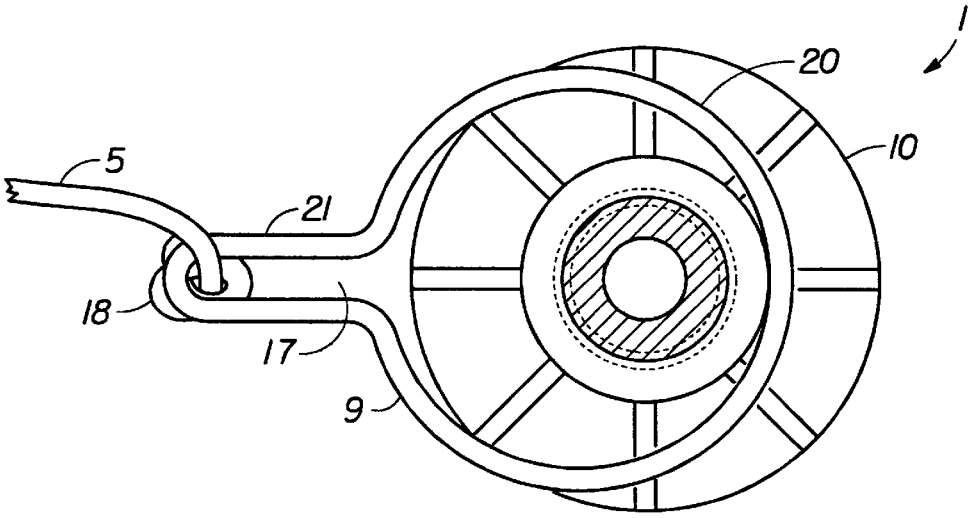
FIG. 4 is a section plan view of the finger ring on the device.

Referring to FIG. 4 there is shown a section plan view of the first device 1 with the finger ring 9 and its method of use.

The first device 1 is shown suitably fixed to the dock with the H bar pulling up on the underside of the planks and the threaded base plate 10 pulling down on the top of planks. The finger ring 9 is shown disposed about the tee rim 20 and is loosely held between the threaded mushroom head and the threaded base plate 10 thereby allowing the finger ring 9 to rotate freely about tee rim 20 that is part of the threaded base plate 10. The rope 5 is shown captured in the finger slot 17 formed in the ring finger 21 wherein the knot 18 is too wide to slip through the finger slot 17.

To remove the rope 5 from the finger slot 17 formed in the ring finger 21 the rope 5 is pulled through the first end of the finger slot 17 toward the center of the threaded mushroom head 11 until the knot 18 is past the finger slot 17 and in the ring area of the finger ring 9 wherein the knot 18 and rope 5 are easily withdrawn.

Figure 5:
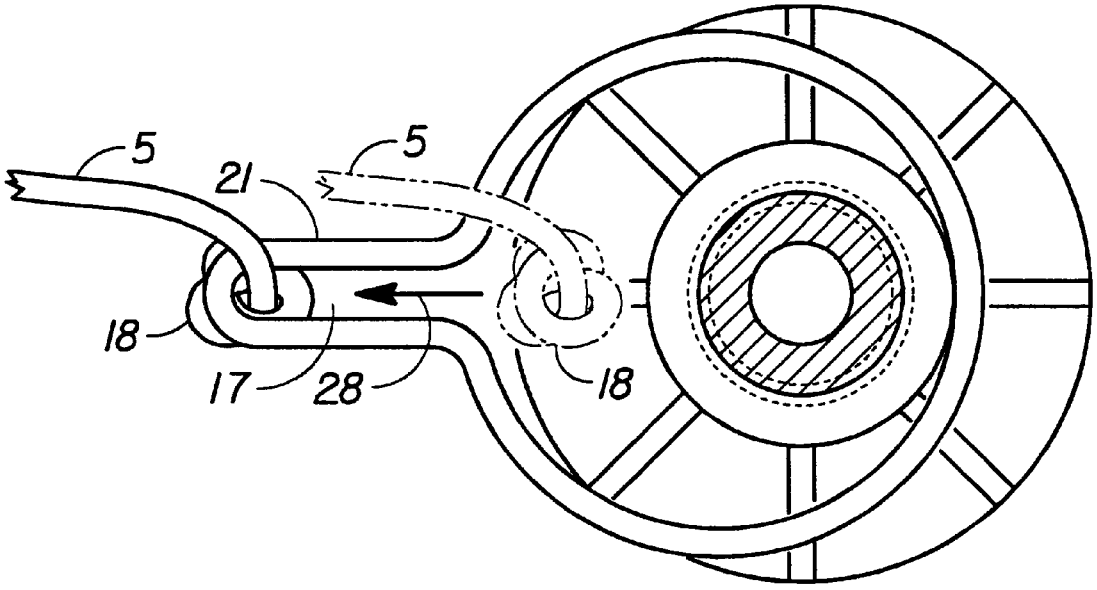
FIG. 5 is a section plan view of a rope being placed in the ring finger of the device.

Referring to FIG. 5 the is shown a plan view of the method of the rope 5 being placed in the ring finger 21.

The rope 5 with a knot 18 is placed in the first end of the ring finger 21 where the ring finger 21 intersects the finger ring 9 and the knot is somewhat below the finger slot 17 and the rope 5 extends above the finger slot 17 wherein the rope 5 is pulled into the second end of the ring finger 21 and the finger slot 17 and the knot 8 is pulled 28 below the finger slot 17 unable to be pulled through the finger slot 17 until the rope 5 is pulled to the second end of the ring finger 4 wherein it is captured in the ring finger 21.

Figure 6:
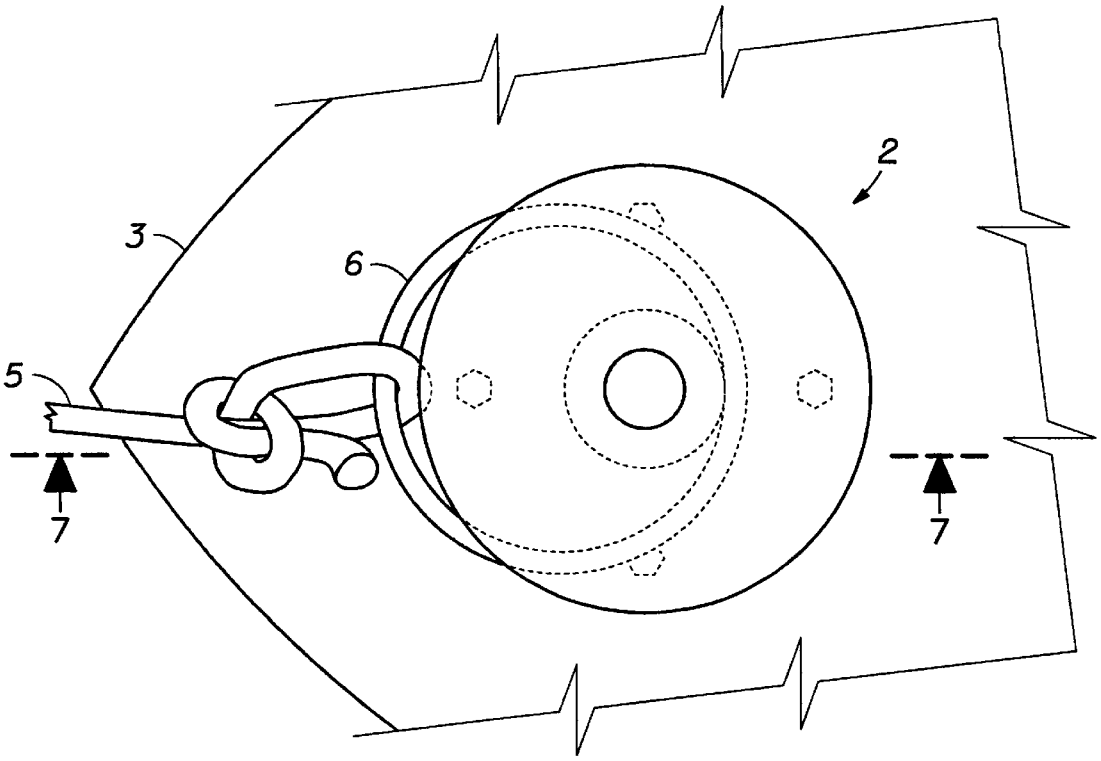
FIG. 6 is a plan view of the second device with a rope tied to a ring.

Referring to FIG. 6 there is shown a plan view of the second device 2 on a boat 3 and method of tying a rope 5 to the ring 6 of the second device 2 of the second preferred embodiment.

Any suitable knot is formed by the rope 5 to tie the rope 5 to the ring 6.

Figure 7:
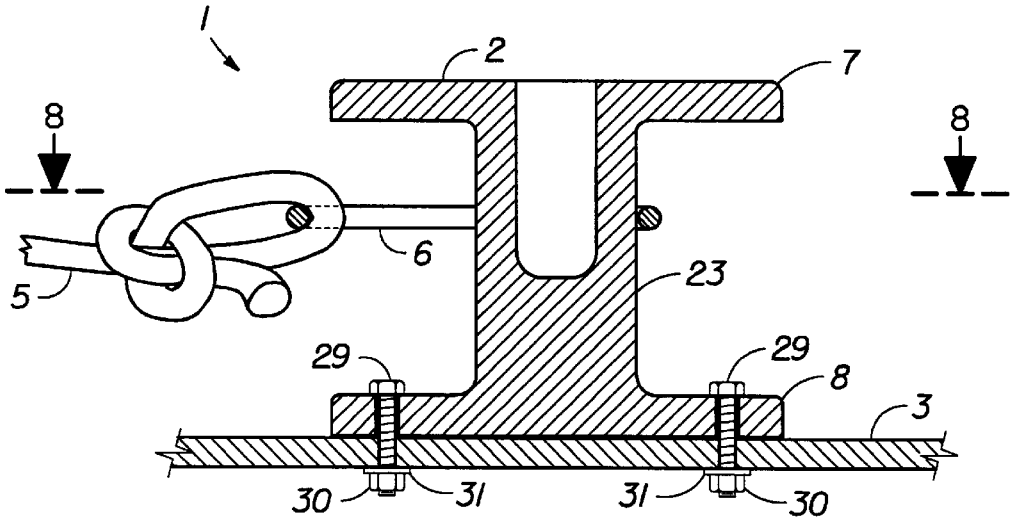
FIG. 7 is a section elevation of a rope tied to a ring.

Referring to FIG. 7 there is shown a section elevation of the second device 2 bolted to the deck of a boat 3 as taken through FIG. 6. Although the second device is shown suitably bolted to the deck of a boat 3 it could also be bolted to a wooden dock or a concrete pier not shown.

The bolt on base plate 8 has a first end and a second end wherein the second end of the bolt on base plate 8 is fixed to the first end of the stanchion 23 and the second end of the stanchion 23 is fixed to the first end of the mushroom head 7. The bolt on base plate 8 is further shown bolted to the boat 3 on the deck of the boat 3. The bolts 29 pass through holes 32 formed in the bolt on base plate 8 that extends from the first end through the second end of the bolt on base plate 8. The bolts 29 are suitably fixed to the boat deck by nuts 30 and washers 31. A rope 5 is shown tied to the ring 6 with a suitable knot.

A ring 6 is shown disposed about the stanchion and the ring has an inside diameter and an outside diameter and the inside diameter is less than the outside diameter of the mushroom head. The finger ring with the ring finger could also be used on the second device 2 and the ring 6 could also be used on the first device.

Figure 8:
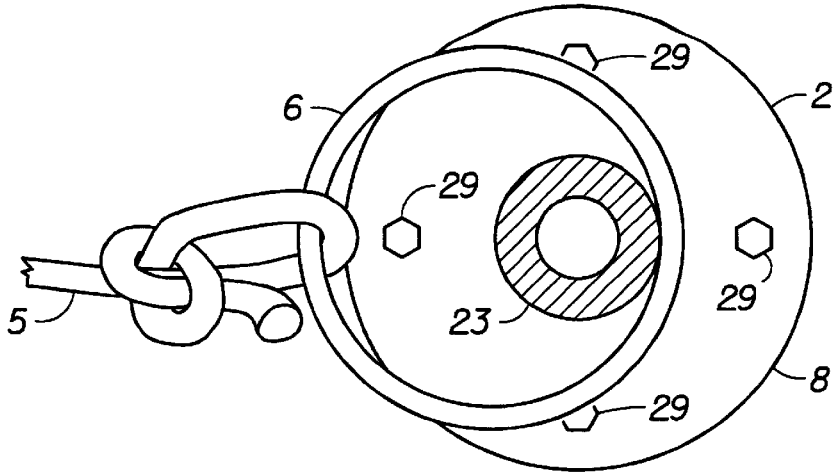
FIG. 8 is a section plan view of the device with a rope tied to a ring.

Referring to FIG. 8 there is shown a section plan view of the second device 2.

A rope 5 is shown suitable tied to the ring 6. The ring 6 is disposed about the stanchion 23 and is shown above the bolt on base plate 8. Four bolts 29 are shown fixing the second device 2 to the boat.

Figure 9:
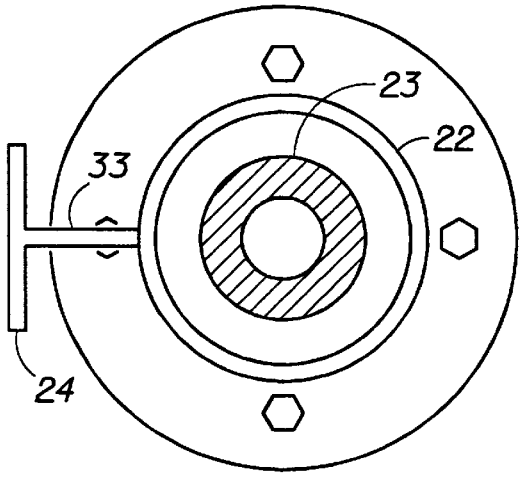
FIG. 9 is a plan view of a T ring disposed about the stanchion of the device.

Referring to FIG. 9 there is shown a section plan view of a T ring 22 that would take the place of a ring or finger ring.

The T ring 22 is made to act as a cleat that is disposed about the stanchion and can freely rotate about the stanchion 23 of either the first device 1 or the second device 2. The T ring 22 is shown with the first end of an elongated shaft 33 suitably fixed to the T ring 22 by welding or other suitable means. The second end of the elongated shaft 33 is shown suitably fixed to the T head 24 by welding or some other suitable means.

Figure 10:
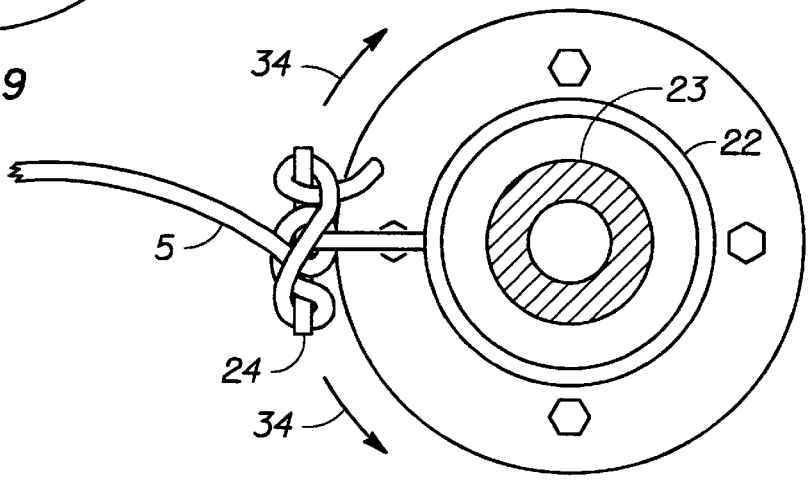
FIG. 10 is a plan view of a rope tied around the T ring.

Referring to FIG. 10 there is shown a section plan view and method of tying a rope 5 to the T head 24.

Any suitable standard knot or means may be used to tie a rope 5 to the T head 24. The T head is similar to a common boat cleat except that it may rotate 34 freely about the stanchion 23.

Although the system described in detail supra has been found to be most satisfactory and preferred, many variations are possible. For example, the mushroom head could be a triangle or a rectangle. The various rings could also be round or rectangular.

Although the invention has been described with reference to the preferred embodiments, it will be understood by those skilled in the art, that additions, modifications, substitutions, deletions and other changes not specifically described may be made in the embodiments herein, it should be understood that the details herein are to be interpreted as illustrative and are not in a limiting sense.

What is claimed as invention is:

1. A device to warp a boat to a wooden dock or pier with a rope with a knot wherein said wooden dock is comprised of boards or planks and said boards and planks have gaps between said boards or planks comprised of;

an H bar with a first end and a second end with a T bar on said first end and a first wing and second wing on said T bar on said first end of said H bar;

a threaded mushroom head with a first end and a second end and with an inside and an outside wherein said second end of said H bar is embedded into the inside and said first end of said threaded mushroom head and wherein said second end of said threaded mushroom head is formed into a mushroom like shape and wherein a thread is formed on the outside near said first end of said threaded mushroom head;

a threaded base plate with a first end, a second end an inside surface and an outside surface wherein said inside surface has threads formed and wherein said threads will mesh with said threads formed on said outside of said threaded mushroom he ad and wherein said first end of said threaded base plate is a greater outside diameter than said second end of said threaded base plate;

a finger ring wherein said finger ring has an in side diameter and a outside diameter and wherein said finger ring has a finger that extends past said outside diameter of said finger ring and said finger further forms a finger slot wherein said rope with a knot is inserted in said finger slot and said rope with a knot is held firmly in said finger slot and wherein the first end of the H bar is inserted into said gap between said boards and said H bar is rotated wherein said first wing and said second wing of said H bar is under said boards and said threaded base plate is rotated about said threaded mushroom head thereby causing said threads on said threaded mushroom head to pull up on said H bar thereby locking said device to said dock and wherein said rope with a knot from said boat is inserted into said finger slot formed in said ring finger and wherein said knot cannot be pulled out of said finger slot and said rope with a knot becomes fixed to said ring finger thereby fixing said boat to said dock.

2. The device of claim 1 wherein said ring finger is further formed into a T ring.

3. The device of claim 2 wherein said T ring has a T head formed on said T ring.

4. The device of claim 1 wherein said base plate further has a base plate flange formed on said first end of said base plate and wherein said base plate flange has at least one bolt hole.

5. A device to warp a boat to a dock or pier with a rope and a knot formed on said rope wherein said device is comprised of:

a mushroom head with a first end, a second end and an outside diameter;

a stanchion with a first end and a second end wherein said first end of said stanchion is fixed to said second end of said mushroom head;

a base plate with a first end and a second end wherein said first end of said base plate is fixed to said second end of said stanchion and wherein said second end of said base plate is fixed to said boat or said dock;

a finger ring wherein said finger ring has an inside diameter and an outside diameter and wherein said finger ring has a finger that extends past said outside diameter of said finger ring and said finger further forms a finger slot wherein said rope with a knot is held in said finger slot and said finger ring and wherein said finger ring is further disposed between said first end of said base plate and said second end of said mushroom head and wherein said finger ring is captured about said stanchion and wherein said rope with said knot is inserted into said finger slot formed in said finger ring and wherein said knot cannot be pulled out of said finger slot and said rope with said knot becomes fixed to said finger ring thereby fixing said rope to said boat or said dock.

6. A method to warp a boat to a wooden dock or pier with a rope with a knot wherein said wooden dock is comprised of boards or planks and said boards or planks have gaps between said boards or planks comprised of;

an H bar with a first end and a second end with a T bar on said first end and a first wing and second wing on said T bar on said first end of said H bar;

a threaded mushroom head with a first end and a second end and with an inside and an outside wherein said second end of said H bar is embedded into the inside and said first end of said threaded mushroom head is formed into a mushroom like shape and wherein a thread is formed on the outside near said first end of said threaded mushroom head;

a threaded base plate with a first end, a second end an inside surface and an outside surface wherein said inside surface has threads formed and wherein said threads will mesh with said threads formed on said outside of said threaded mushroom head and wherein said first end of said threaded base plate is a greater outside diameter than said second end of said threaded base plate;

a finger ring wherein said finger ring has an inside diameter and a outside diameter and wherein said finger ring has a finger that extends past said outside diameter of said finger ring and said finger further forms a finger slot wherein said rope with a knot is inserted in said finger slot and said rope with a knot is held firmly in said finger slot and wherein the first end of the H bar is inserted into said gap between said boards and said H bar is rotated wherein said first wing and said second wing of said H bar is under said boards and said threaded base plate is rotated about said threaded mushroom head thereby causing said threads on said threaded mushroom head to pull up on said H bar thereby locking said device to said dock and wherein said rope with a knot from said boat is inserted into said finger slot formed in said ring finger and wherein said knot cannot be pulled out of said finger slot and said rope with a knot becomes fixed to said ring finger thereby fixing said boat to said dock.

* * * * *